US008696392B2

(12) United States Patent
Yoshida et al.

(10) Patent No.: US 8,696,392 B2
(45) Date of Patent: Apr. 15, 2014

(54) CONTACT AND METHOD FOR MANUFACTURING THE CONTACT

(75) Inventors: Hitoshi Yoshida, Otsu (JP); Hidekazu Yoshioka, Yawata (JP); Takahiro Sakai, Yasu (JP); Yoshihiro Shimizu, Moriyama (JP); Toshio Yamashita, Moriyama (JP)

(73) Assignee: OMRON Corporation, Kyoto (JP)

( * ) Notice: Subject to any disclaimer, the term of this patent is extended or adjusted under 35 U.S.C. 154(b) by 207 days.

(21) Appl. No.: 13/264,769

(22) PCT Filed: Mar. 24, 2011

(86) PCT No.: PCT/JP2011/057162

§ 371 (c)(1),
(2), (4) Date: Dec. 16, 2011

(87) PCT Pub. No.: WO2012/124168

PCT Pub. Date: Sep. 20, 2012

(65) Prior Publication Data

US 2012/0238158 A1 Sep. 20, 2012

(30) Foreign Application Priority Data

Mar. 15, 2011 (JP) ..... 2011-057075

(51) Int. Cl.
*H01R 13/02* (2006.01)

(52) U.S. Cl.
USPC ..... 439/886

(58) Field of Classification Search
USPC ..... 439/886
See application file for complete search history.

(56) References Cited

U.S. PATENT DOCUMENTS 5,066,550 A * 11/1991 Horibe et al. ..... 428/670
6,439,975 B1 * 8/2002 Shih et al. ..... 451/57
6,732,606 B1 * 5/2004 Zhu et al. ..... 74/460
6,811,420 B2 11/2004 Miura (Continued)

FOREIGN PATENT DOCUMENTS

JP 55-144617 A 11/1980
JP 04-082176 A 3/1992
JP 10-199651 A 7/1998
JP 2003-45539 A 2/2003

(Continued)

OTHER PUBLICATIONS

International Search Report from PCT/JP2011/057162 dated Apr. 26, 2011 (2 pages).

(Continued)

*Primary Examiner* — James Harvey
(74) *Attorney, Agent, or Firm* — Osha Liang LLP

(57) ABSTRACT

A contact includes a plate with a width that ranges from 0.1 mm or more to 1 mm or less, and a stress concentrated place, where a surface roughness (Ra) on the stress concentrated place is 0.2 μm or less. When samples whose surface roughness Ra is 0.040 μm, 0.080 μm, 0.120 μm, and 0.180 μm were used to study a number of repetitive fracture times, as the surface roughness Ra was smaller, the number of repetitive fracture times became larger. Particularly, it is found that the surface roughness Ra may be 0.200 μm or less in order to satisfy 3000 times as a number of operating times of the battery connector. Further, the surface roughness Ra may be 0.080 μm or less in order to satisfy 6000 times as the number of operating times when a safety factor is 2.

5 Claims, 9 Drawing Sheets

(56) References Cited

U.S. PATENT DOCUMENTS

| | | | | |
|---|---|---|---|---|
| 7,820,068 | B2 * | 10/2010 | Wang et al. | 252/79.1 |
| 2002/0177343 | A1 * | 11/2002 | Miura | 439/266 |
| 2005/0042905 | A1 * | 2/2005 | Miura | 439/266 |
| 2006/0280961 | A1 * | 12/2006 | Yamada et al. | 428/671 |
| 2009/0169726 | A1 * | 7/2009 | Fujii et al. | 427/77 |
| 2010/0081299 | A1 | 4/2010 | Hemmi et al. | |
| 2010/0282397 | A1 * | 11/2010 | Yamada et al. | 156/150 |
| 2012/0238158 | A1 * | 9/2012 | Yoshida et al. | 439/884 |

FOREIGN PATENT DOCUMENTS

| | | | |
|---|---|---|---|
| JP | 04-024826 | B1 | 12/2007 |
| JP | 2010-86878 | A | 4/2010 |
| KR | 2002-0089151 | A | 11/2002 |

OTHER PUBLICATIONS

Written Opinion from PCT/JP2011/057162 dated Apr. 26, 2011 (4 pages).

Espacenet Abstract JP4024826B1 dated Dec. 19, 2007 (1 page).

* cited by examiner

CONTACT AND METHOD FOR MANUFACTURING THE CONTACT

CROSS-REFERENCE TO RELATED APPLICATIONS

The present application claims priority from Japanese Patent Application Publication No. 2011-057075, filed Mar. 15, 2011. The content of the priority application is hereby incorporated by reference in its entirety.

BACKGROUND OF INVENTION

1. Technical Field

One or more embodiments of the present invention relate to a contact and a method for manufacturing the contact. For example, one or more embodiments of the present invention relates to the contact that is incorporated into a housing and forms a connector, and the method for manufacturing the contact.

2. Background Art

Small connectors that are packaged to wiring substrates are used for connecting flexible printed substrates and the like. Metal plates with thickness of about 100 μm are mostly used for contacts to be used in such connectors.

As a method for manufacturing the contact is generally a method for punching a thin metal plate with a press. In the manufacturing method with a press, for example as shown in FIG. 1A, a thin metal plate 11 is placed on a die 12 for press, and a press die 14 is moved down from above the die 12. As shown in FIG. 1B, the metal plate 11 is shear-fractured by a punching hole 13 of the die 12 and the press die 14, and thus a contact 15 is manufactured. In the contact 15 that is punched by pressing, minute unevenness is generated on its punched surface. FIG. 2 illustrates a cut section (microphotograph) of the metal plate punched with the press. As shown in FIG. 2, a sagging surface D1 having a smooth round shape, a glossy shear plane D2 on which vertical lines are arranged, a fracture surface D3 on which as if a metal material is torn off, and a burred surface D4 on which burr occurs are formed on the cut section of the metal plate punched by pressing in this order from an upper surface side to a lower side. Particularly, the shear plane D2 has unevenness whose difference of elevation is the largest in FIG. 2, and protrudes the highest from this cut section. FIG. 2 is upside down with respect to FIG. 1 and FIGS. 3A-3D.

FIGS. 3A to 3D illustrate a mechanism where the cut section in FIG. 2 is generated on the metal plate. As shown in FIG. 3A, when the press die 14 moves down, a lower surface of the press die 14 touches the metal plate 11 so as to push down the metal plate 11. When the press die 14 pushes down the metal plate 11, as shown in FIG. 3B, sagging (D1) is generated on a cutting edge side surface of the press die 14 and a cutting edge side surface of the die 12 on the metal plate 11, respectively. Further, when the press die 14 moves down, the metal plate 11 receives a shear stress from the press die 14 and the die 12, and a shear plane (D2) is generated following the sagging (D1). When the press die 14 is further moves down, as shown in FIG. 3C, cracks 16 are generated on the metal plate 11 respectively, by an edge of the press die 14 and an edge of the die 12. At this time, the cutting edge side surface of the press die 14 and the cutting edge side surface of the die 12 become shear planes, and the cracks 16 become fracture surfaces (D3). Thereafter, as shown in FIG. 3D, the crack 16 on the side of the press die 14 and the crack 16 on the side of the die 12 are connected, so that the punching is completed. Therefore, the punching work is completed at a stage that the press die 14 enters about ⅔ of the metal plate 11. A suitable gap is necessary between the side surface of the press die 14 and the side surface of the punching hole 13 in order to connect the crack 16 on the side of the press die 14 and the crack 16 on the side of the die 12. This gap is called as a clearance, but a burr (D4) occurs at an end of the contact 15 due to the clearance.

When an operation is repeatedly performed for a long time, destruction such as sudden fracture occurs on the contact. This is called as fatigue fracture. The fatigue fracture is caused by some factors, but when a load is repeatedly applied to a plate material such as a contact, a maximum stress is generated on the surface of the plate material, and stress concentration on concave portions due to surface roughness is one of the main factors of the fatigue fracture.

When the contact is manufactured by the pressing work, this cut section becomes an outer peripheral surface of the contact. When a contact point of the contact is pressure-welded with an electrode section on a counterpart side, a spring section (elastically deformed section) of the contact is warped by the stress. Particularly, when a contact pressure is heightened, a bending moment applied to the spring section becomes large accordingly. For this reason, a large load is applied to the contact section and the spring section, but when the surfaces of the contact section and the spring section become cut sections at the time of the pressing work, stress concentration occurs on the unevenness or the like of the shear plane, and thus a number of repetitive fracture times of the contact is reduced.

Particularly, the contact is also miniaturized according to weight saving and shortening of a connector. For this reason, an unevenness dimension ratio of the maximum stress portion of the contact to a part cross-section becomes large, and thus the contact is easily fractured.

Patent Document 1: Japanese Unexamined Patent Publication No. 2010-86878

SUMMARY OF INVENTION

One or more embodiments of the present invention may provide an inexpensive contact having high durability and a method for manufacturing the contact.

The contact according to one or more embodiments of the present invention is characterized in that a plate width is 0.1 mm or more and 1 mm or less and surface roughness Ra on a stress concentrated place is 0.2 μm or less. According to such a contact, because the surface roughness Ra is 0.2 μm or less, the fracture due to the stress concentration on the contact hardly occurs, and the operation can be performed 3,000 times or more in a case of a battery connector.

When the plate width is 0.1 mm or more and 1 mm or less, durability is approximately equivalent and quality can be stabilized.

The contact according to one or more embodiments of the present invention is characterized in that the surface roughness Ra is 0.08 μm or less. With such a surface roughness Ra, in a case of a battery connector, an operation can be performed at 6,000 times or more.

The contact according to one or more embodiments of the present invention is characterized in that the surface roughness Ra is 0.04 μm or more. When the surface roughness Ra is made to be smaller than 0.04 μm by etching or polishing, the plate width and a plate thickness that are necessary for maintaining a function of the contact become small.

A first method for manufacturing the contact of one or more embodiments of the present invention is characterized by including the steps of manufacturing the contact by means of punching with a press, and etching or polishing a surface of the contact manufactured in the above step so that surface the roughness Ra is 0.2 μm or less. With such a manufacturing method, because the contact is manufactured by punching with a press and etching (chemical polishing) or polishing (buffing, electrolytic polishing or the like), the contact having high durability can be manufactured at a low price.

A second method for manufacturing the contact of one or more embodiments of the present invention is characterized by including the steps of forming a resist film on an electrode plate, exposing and developing the resist film so as to form a cavity, molding a contact in the cavity by means of electroforming, and etching or polishing a surface of the contact separated from the resist film so that the surface roughness Ra is 0.2 μm or less. With such a manufacturing method, after the contact is manufactured by photolithography and electroforming, the surface roughness Ra can be easily small by etching (chemical polishing) or polishing (buffing, electrolytic polishing or the like).

A third method for manufacturing the contact of one or more embodiments of the present invention is characterized by including the steps of pasting a dry film resist closely onto an electrode plate, exposing and developing the dry film resist with a protection film remaining on the surface of the dry film resist so as to form a cavity, molding a contact in the cavity by means of electroforming, and etching or polishing a surface of the contact separated from the dry film resist so that the surface roughness Ra is 0.2 μm or less. When the exposure and development are carried out in the state that the protection film remains on the dry film resist, unevenness occurs on the surface of the contact, but the surface roughness Ra of the contact can be small by etching (chemical polishing) or polishing (buffing, electrolytic polishing or the like).

A fourth method for manufacturing the contact of one or more embodiments of the present invention is characterized by including the steps of applying a resist liquid onto an electrode plate so as to form a resist film, forming a cavity on the resist film by means of an LIGA process, and molding a contact in the cavity by means of electroforming. Because a wall surface of the cavity can be smoothly formed by the LIGA process, the contact whose surface roughness Ra is small can be manufactured without etching and polishing in a later step.

A fifth method for manufacturing the contact of one or more embodiments of the present invention is characterized by including the steps of applying a resist liquid onto an electrode plate so as to form a resist film, forming a cavity on the resist film by means of a UV-LIGA process, and molding a contact in the cavity by means of electroforming. According to the UV-LIGA process, because the wall surface of the cavity can be smoothly formed, the contact whose surface roughness Ra is small can be manufactured without etching and polishing in a later step.

A sixth method for manufacturing the contact of one or more embodiments of the present invention is characterized by including the steps of pasting a dry film resist closely onto an electrode plate and removing a protection film from the surface so as to expose a photosensitive layer, exposing and developing the photosensitive layer in a non-oxygen atmosphere so as to form a cavity, and molding a contact in the cavity by means of electroforming. The dry film resist is pasted closely and the protection film is removed from the surface and is exposed, the wall surface of the cavity can be smoothly formed. For this reason, the contact whose surface roughness Ra is small can be manufactured without etching and polishing in a later step. However, when the protection film is removed, oxygen inhibition occurs depending on a photosensitive layer, and thus exposure and development are carried out in a non-oxygen atmosphere in order to prevent the oxygen inhibition.

A seventh method for manufacturing the contact of one or more embodiments of the present invention is characterized by including the steps of pasting a dry film resist, in which transparency, a particle shape or a particle diameter of a lubricant of the protection film is adjusted, closely onto an electrode plate, exposing and developing the dry film resist so as to form a cavity, and molding a contact in the cavity by means of electroforming. When the lubricant in the protection film is selected, the wall surface of the cavity can be smoothly formed. For this reason, the contact whose surface roughness Ra is small can be manufactured without etching and polishing in a later step.

One or more embodiments of present invention has a characteristic where the components are suitably combined, and the one or more embodiments of the present invention enable a lot of variations according to the combinations of the components.

DETAILED DESCRIPTION

One or more embodiments of the present invention will be described below with reference to accompanying drawings. The present invention is not limited to the following embodiments, and the design can be variously changed without departing from one or more embodiments of the present invention. In embodiments of the invention, numerous specific details are set forth in order to provide a more thorough understanding of the invention. However, it will be apparent to one with ordinary skill in the art that the invention may be practiced without these specific details. In other instances, well-known features have not been described in detail to avoid obscuring the invention.

(Contact for Connector)

Figure 1A:
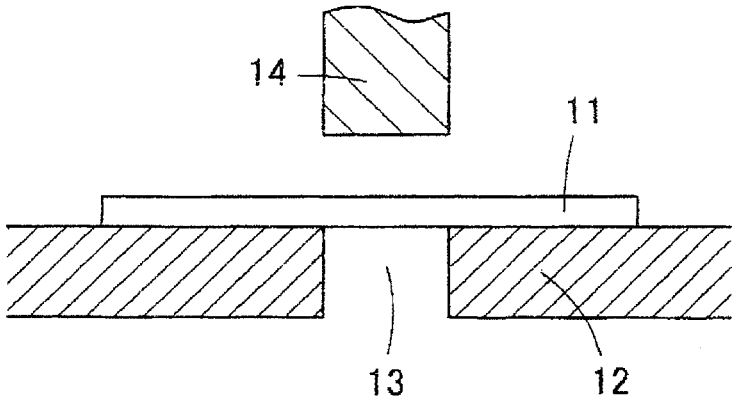
FIG. 1A Prior Art
FIGS. 1A and 1B are schematic views describing a method for manufacturing a contact using a press.
Figure 1B:
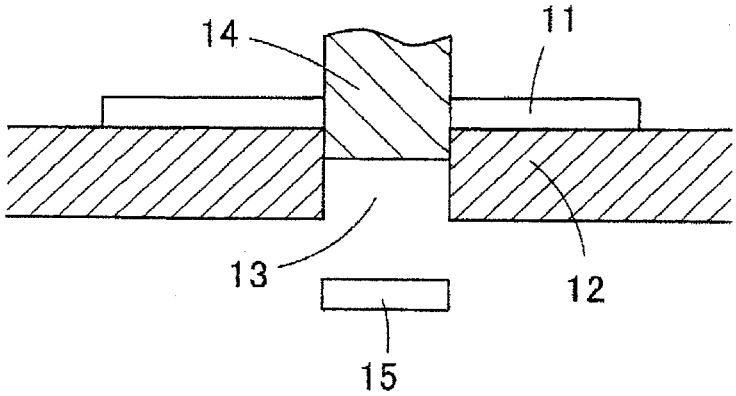
FIG. 1B Prior Art
Figure 2:
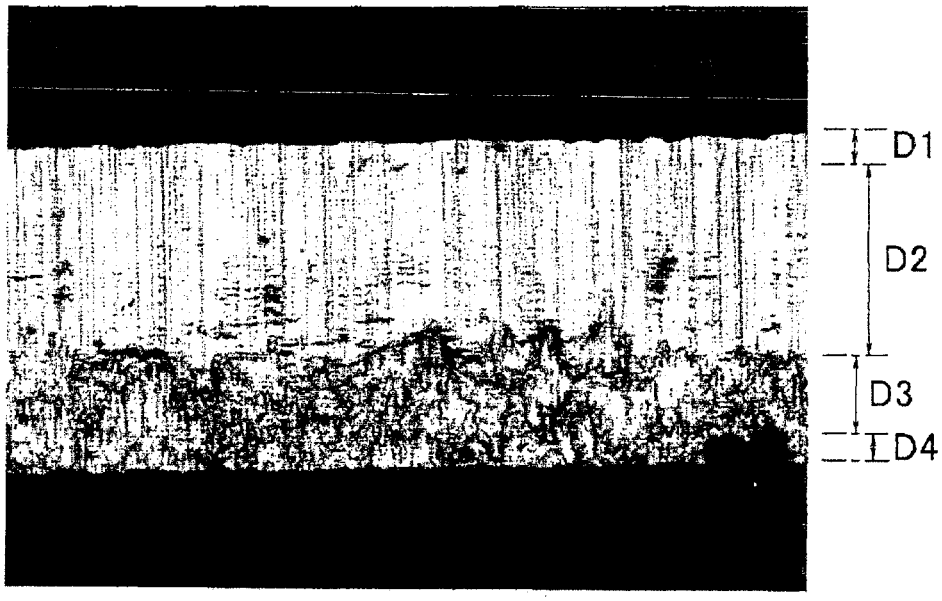
FIG. 2 Prior Art
FIG. 2 illustrates a cross section of a metal part punched by the press.
Figure 3A:
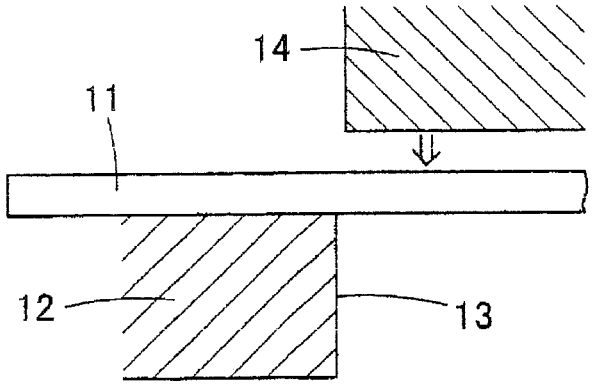
FIG. 3A Prior Art
FIGS. 3A to 3D are views for describing a mechanism where a cut section is generated on a metal plate.
Figure 3B:
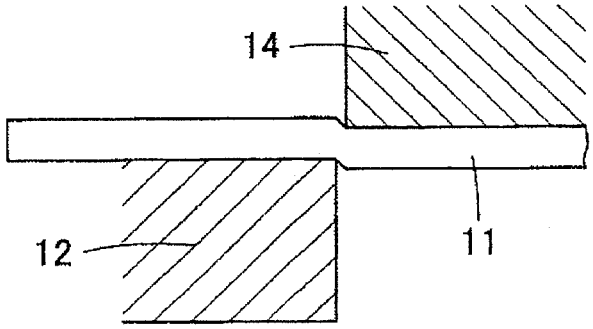
FIG. 3B Prior Art
Figure 3C:
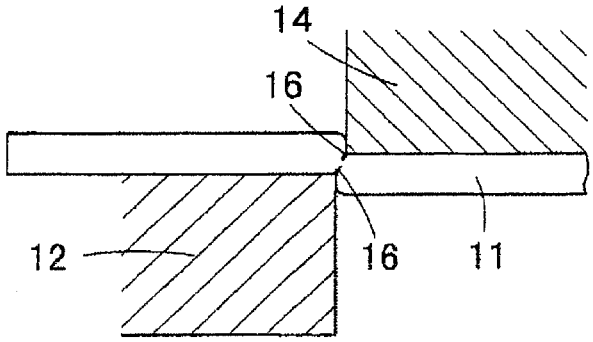
FIG. 3C Prior Art
Figure 3D:
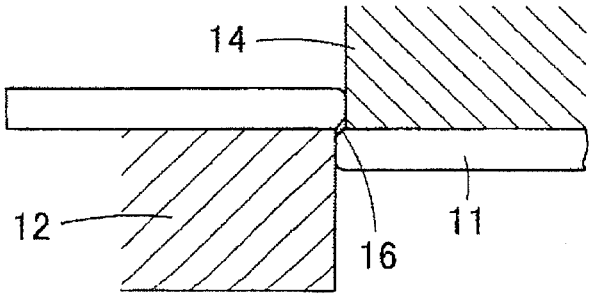
FIG. 3D Prior Art
Figure 4:
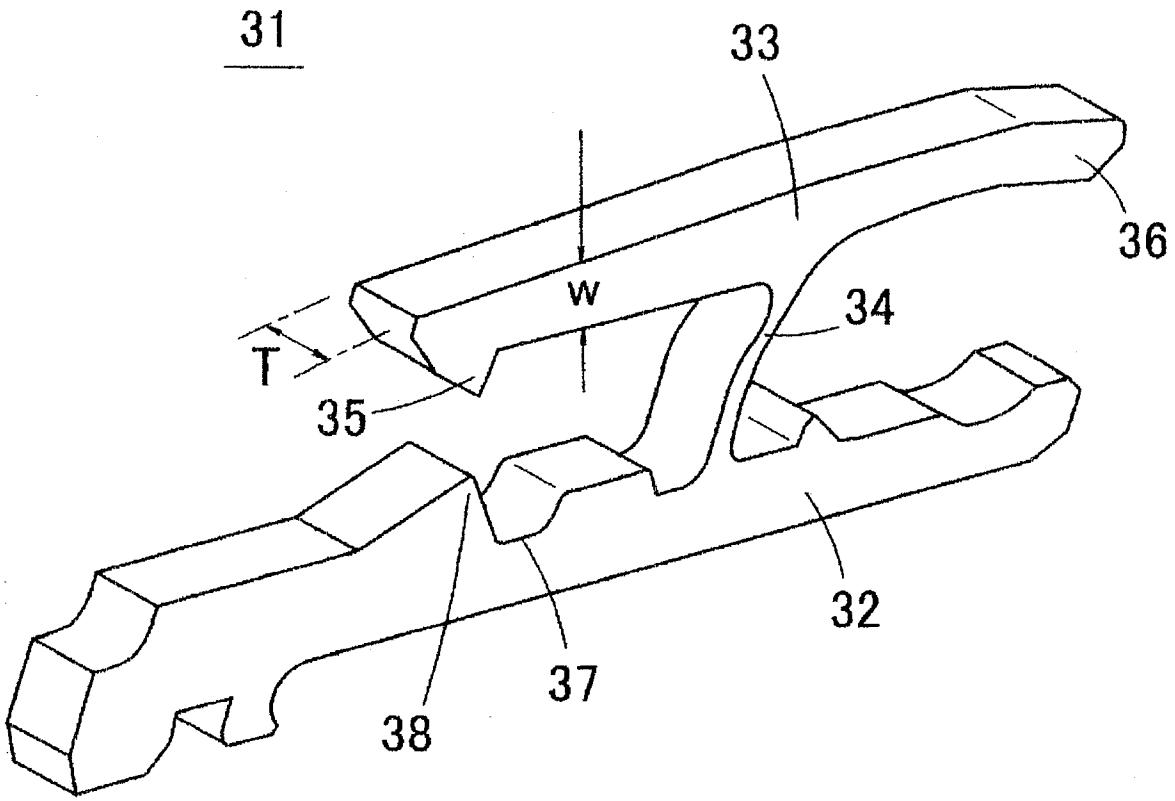
FIG. 4 is a perspective view illustrating the contact for a connector according to one or more embodiments of the present invention.
Figure 5:
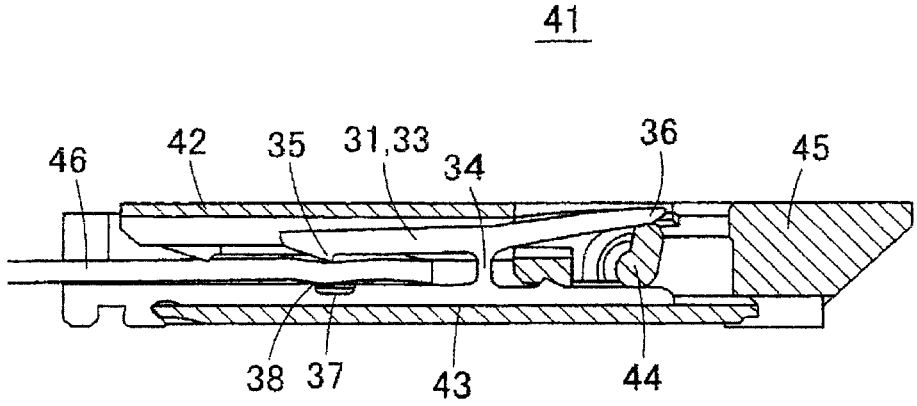
FIG. 5 is a cross-sectional view illustrating the connector into which the contact of FIG. 4 is incorporated according to one or more embodiments of the present invention.

A contact for a connector will be described with reference to FIG. 4 and FIG. 5. FIG. 4 is a perspective view illustrating a contact 31 for a connector (a connecting terminal for the connector). FIG. 5 is a cross-sectional view illustrating a connector 41 into which the contact 31 is incorporated.

As shown in FIG. 4, the contact 31 has a shape such that a fixed piece 32 and a movable piece 33 are arranged approximately in parallel, and an approximately central upper surface of the fixed piece 32 and an approximately central lower surface of the movable piece 33 are connected by a connecting section 34 approximately vertical to both the pieces 32 and 33. A movable contact point 35 having a triangular protruding shape is provided on a front end lower surface of the movable piece 33, and a rear end section of the movable piece 33 is an operation receiving section 36 for tilting the movable piece 33 using a cam section. Further, a groove section 37 and a slipping-off preventing protrusion 38 are provided on an upper surface of the fixed piece 32 opposed to the movable contact point 35.

The contact 31 is, as shown in FIG. 5, incorporated into a housing 42 of the connector 41. The contact 31 is fixed by press-fitting the fixed piece 32 into an insertion hole 43 of the housing 42. A cam section 44 for pushing up the operation receiving section 36 is positioned between a rear end upper surface of the fixed piece 32 and a lower surface of the operation receiving section 36. The cam section 44 is formed integrally with an operation lever 45, and the operation lever 45 is raised and laid so that the cam section 44 rotates. In a state that the operation lever 45 is raised, the cam section 44 is laid onto its side, and does not influence the operation receiving section 36. Therefore, at this time, a gap between the movable contact point 35 and the fixed piece 32 becomes wide, and thus an end portion of a flexible printed substrate 46 can be inserted/removed into/from the gap between the movable contact point 35 and the fixed piece 32.

In the state that the operation lever 45 is raised and the gap between the movable contact point 35 and the fixed piece 32 is wide, when the end portion of the flexible printed substrate 46 is inserted into the gap and the operation lever 45 is laid, the flexible printed substrate 46 is connected to the connector 41. That is to say, when the end of the flexible printed substrate 46 is inserted into the gap and the operation lever 45 is laid, the cam section 44 rotates accordingly, and the cam section 44 is in a vertical position. As a result, when the operation receiving section 36 is pushed up by the cam section 44, and the movable piece 33 tilts so that the movable contact point 35 lowers. Thereafter, the movable contact point 35 pressure-contacts with an electrode section (not shown) of the flexible printed substrate 46, the flexible printed substrate 46 is caught in a warped manner between the movable contact point 35, and the groove section 37 and slipping-off preventing protrusion 38 so as to be prevented from slipping off.

(Battery Connector)

Figure 6:
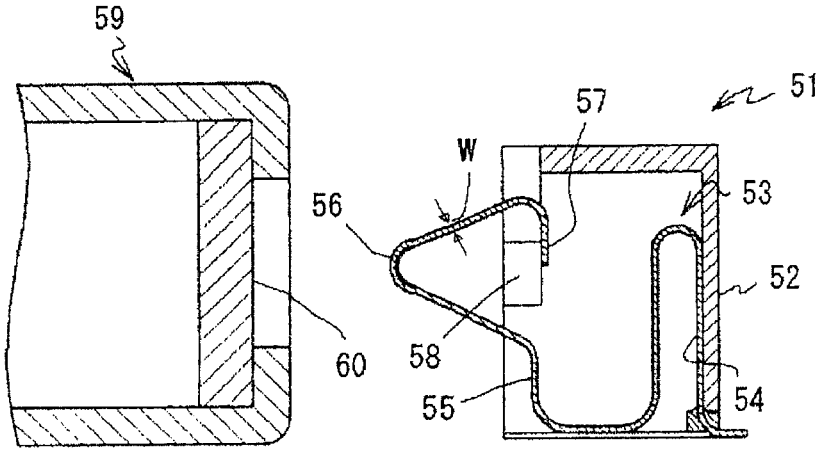
FIG. 6 is a cross-sectional view illustrating a battery connector according to one or more embodiments of the present invention.

For example, a connector that is made to be contact with an electrode pad of a battery to be used in a portable electronic device so as to perform charging will be described below. FIG. 6 is a cross-sectional view illustrating a battery connector 51.

In the connector 51, as shown in FIG. 6, a connector housing 52 houses a plurality of contacts 53, and parts of the contacts 53 are allowed to protrude from a front surface of the connector housing 52.

The contact 53 is configured of a fixing section 54, an elastic section 55, a contact section 56 and a latch section 57. The fixing section 54 of the contact 53 extends along an inner surface of the connector housing 52, and lower end portion thereof is fixed to the connector housing 52.

The elastic section 55 of the contact 53 has an approximately S shape, and the contact 53 can generate a sufficient biasing force to a font-rear direction.

The contact section 56 of the contact 53 is bent backward from a front end of the elastic section 55 into an approximately U shape or an arc shape.

The latch section 57 of the contact 53 is formed so as to be further folded downward from the end portion of the contact section 56, and the latch section 57 is latched by a contact support section 58 provided at an opening of the connector housing 52.

The connector 51 comes into contact with a battery 59 for a portable device. That is to say, when the battery 59 is pressed against the connector 51, the contact section 56 comes into contact with an electrode section 60 of the battery 59 so as to be warped, and an electric current for charge is supplied from the connector 51 to the battery 59.

(Surface Roughness of the Contact)

As to such a contact for the battery connector, as an example, a relationship between its surface roughness Ra (the surface roughness Ra of an outer peripheral surface vertical to both side surfaces) and a number of repetitive fracture times was studied. In this case, the surface roughness (arithmetic average roughness) Ra is defined as follows. When a surface shape of a certain cross section is considered, a y axis is set in a direction vertical to the surface (height direction), and an x direction is set along a direction parallel with the surface, and the surface shape is expressed by a roughness curve y=f(x). The x axis is determined so as to match with an average line. That is to say, an origin in the height direction (position of y=0) is determined so that the following mathematical formula 1 is satisfied in a region where the surface roughness is considered (from x=0 to x=L). A value to be obtained according to the following mathematical formula 2 in the region [0,L]

that is expressed by μm is average roughness Ra.

$$\int_0^L f(x)dx = 0 \quad \text{(Mathematical Formula 1)}$$

$$Ra = \frac{1}{L}\int_0^L |f(x)|dx \quad \text{(Mathematical Formula 2)}$$

Figure 7:
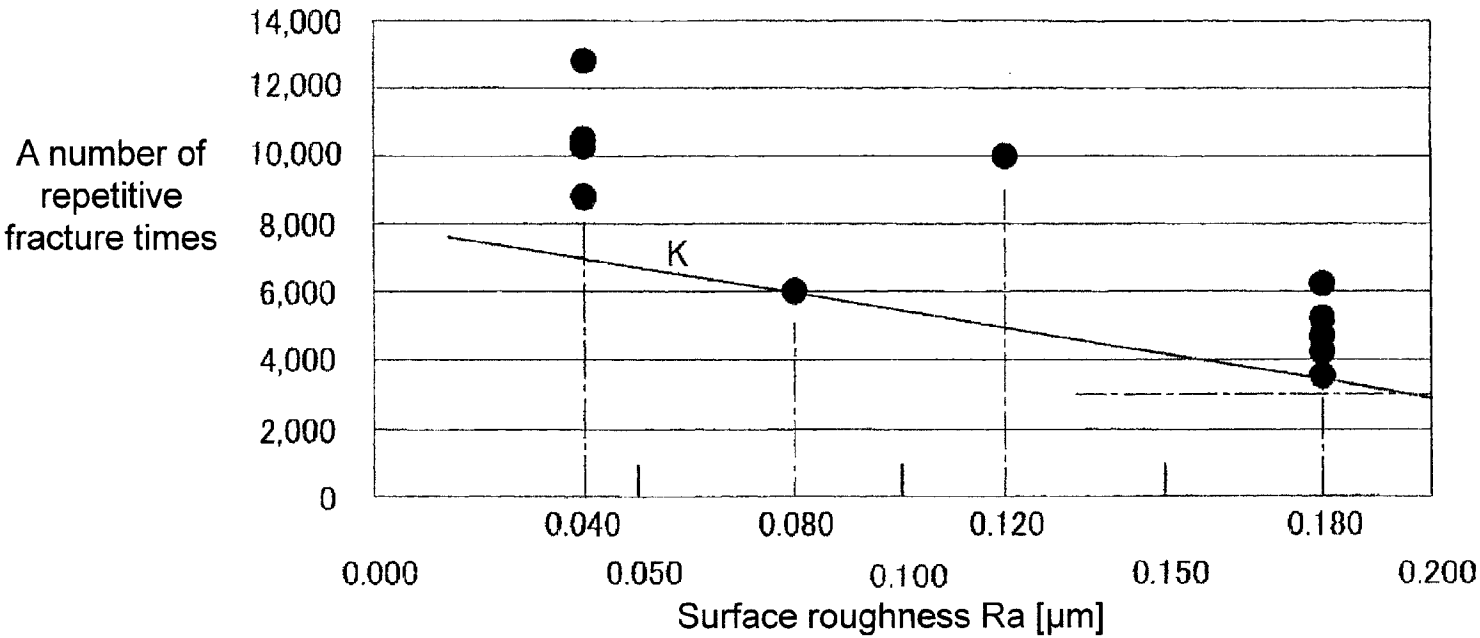
FIG. 7 is a view illustrating a relationship between surface roughness Ra and a number of repetitive fracture times according to one or more embodiments of the present invention.

FIG. 7 illustrates a relationship between the surface roughness Ra obtained by an experiment and the number of repetitive fracture times. In this experiment, the contact for a battery connector shown in FIG. 6 that was made of Ni alloy and has a plate thickness of 250 μm was used. Four kinds of samples whose surface roughness Ra was 0.040 μm, 0.080 μm, 0.120 μm, and 0.180 μm were manufactured. As to the samples with the respective surface roughness, six kinds of samples that had plate widths in a range from 0.1 to 1.0 mm and the surface roughness Ra of 0.040 μm, one sample having the surface roughness Ra of 0.080 μm, one sample having the surface roughness Ra of 0.120 μm, and seven kinds of samples having the surface roughness Ra of 0.180 μm were manufactured. A load was applied so that a maximum stress became 1000 MPa (spring limit value), and the contact was elastically deformed in a repeated manner, and the number of times until the contact was fractured was measured. Individual data about the measurement are shown by black circles in FIG. 7. Because a repetitive fracture test was a test method having large dispersion, as the number of repetitive fracture tests, a minimum value was adopted. A straight line K in FIG. 7 illustrates the relationship between the surface roughness Ra and the number of repetitive fracture times.

The plate thickness T of the contact is a thickness of the contact in a direction vertical to a plane where the contact is deformed as shown in FIG. 6 and FIG. 4 (in a case where the contact is punched with a press, a thickness of a metal plate to be a material), and a plate width w is a width of the contact in the plane.

With reference to FIG. 7, the surface roughness Ra of the contact should be 0.2 μm or less in order that a number of operations in the battery connector becomes 3,000. Further, the surface roughness Ra of the contact should be 0.1 μm or less, and may be 0.08 μm or less in order that the number of repetitive fracture times becomes 6,000 that is obtained by multiplying the number of operations in the battery connector by about 2 as a safety factor.

On the other hand, in a method for reducing the unevenness on the surface of the contact by means of etching, the surface roughness Ra can be 0.04 μm or less. However, it takes a time to completely eliminate the unevenness by means of etching, and when the etching is carried out until the surface roughness Ra is 0.04 μm or less, the plate width w and the plate thickness T necessary for maintaining the function of the contact become small, and thus the etching is not realistic. Therefore, it is possible that the surface roughness Ra of the contact is 0.04 μm or more.

Figure 8:
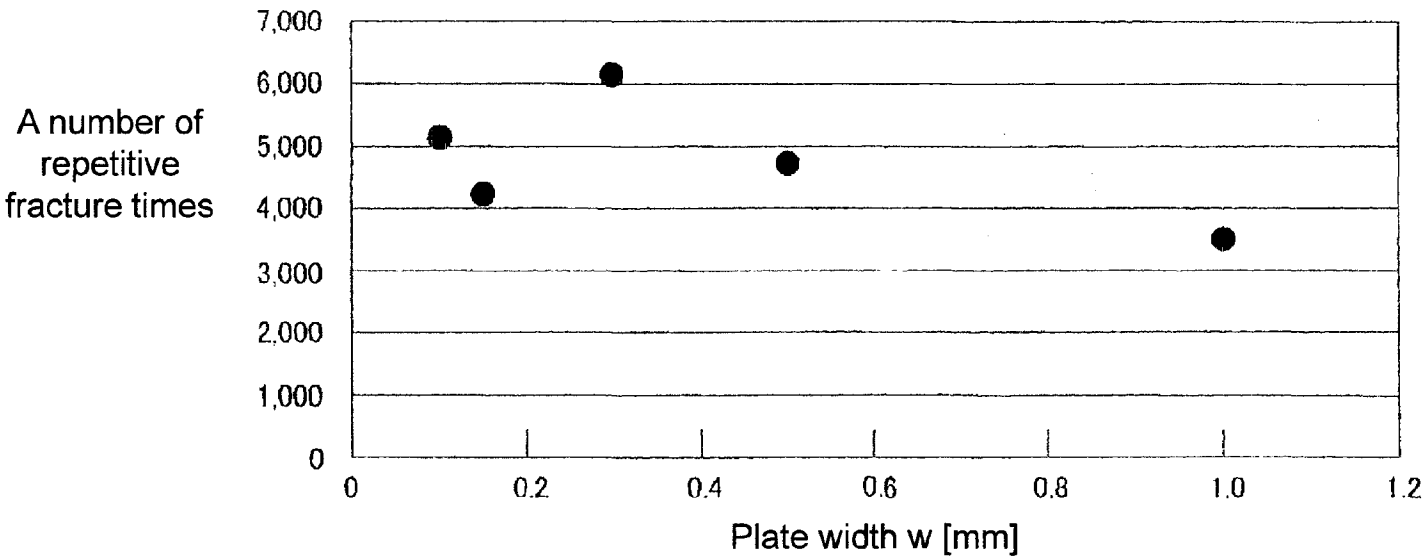
FIG. 8 is a view illustrating a relationship between a plate width w of the contact and the number of repetitive fracture times according to one or more embodiments of the present invention.

FIG. 8 illustrates a relationship between the plate width w and the number of repetitive fracture times of the contact. Also in this measurement, the contact for a battery connector in FIG. 6 that was made of Ni alloy and had the plate thickness of 250 μm was used.

Samples whose plate width w was different from each other in a range of from 0.1 to 1.0 mm were manufactured. The surface roughness Ra of the samples was set to 0.18 μm so that its influence remarkably appears. A load was applied so that the maximum stress became 1000 MPa (spring limit value), and the contact was elastically deformed in a repeated manner, and the number of times until the contact was fractured was measured. Data about the measurements are shown by black circles in FIG. 8. With reference to FIG. 8, when the plate width w is in the range from 0.1 mm or more to 1 mm, there is no significant difference in the number of repetitive fracture times.

As a result, it is possible that the plate width of the contact is 0.1 mm or more and 1 mm or less in order to achieve the required number of repetitive fracture times. It may be that the surface roughness (particularly, the surface roughness on a stress concentrated place) Ra is 0.04 μm or more to 0.2 μm or less, particularly, it is possible that the surface roughness Ra is 0.04 μm or more to 0.080 μm or less.

(Method for Manufacturing the Contact)

A method for manufacturing the contact having the above plate width and surface roughness Ra includes various methods. These methods will be described.

[Manufacturing Method 1]

Figure 9A:
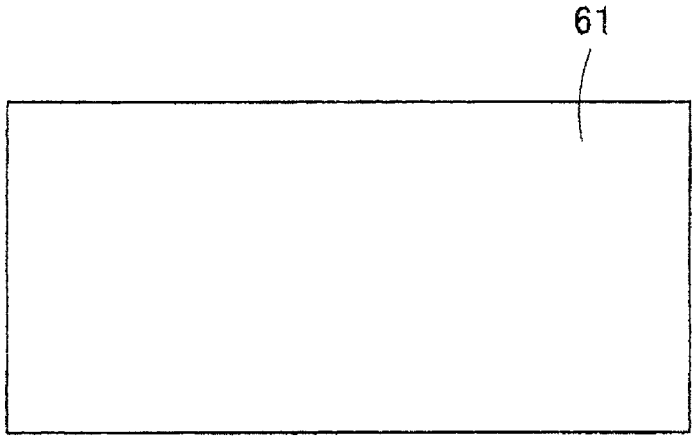
FIGS. 9A to 9D are schematic views describing a method 1 for manufacturing the contact according to one or more embodiments of the present invention.
Figure 9B:
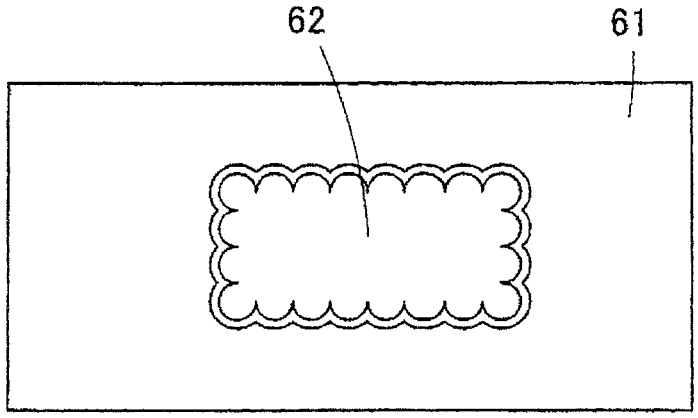
Figure 9C:
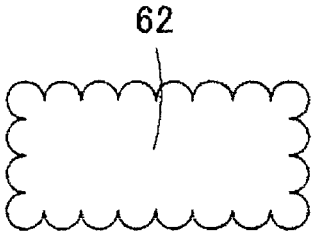
Figure 9D:
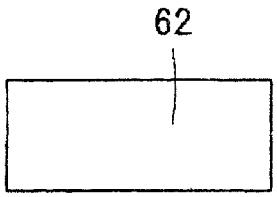

FIG. 9A to FIG. 9D illustrate a method using a press. That is to say, FIG. 9A illustrates a metal plate 61 whose plate thickness T is about 100 μm. The metal plate 61 is punched into a contact shape as shown in FIG. 9B, so that a contact 62 is obtained. When the surface roughness Ra of the contact at this stage was measured, the surface roughness Ra of a shear plane made of phosphor bronze was 0.23 μm. A surface of the contact 62 in FIG. 9C was etched, and unevenness was removed so that the surface was smoothed as shown in FIG. 9D. As an etching liquid used at this time, for example, an etching liquid S-CLEAN S-710 or the like made by SASAKI CHEMICAL CO., LTD. was used. As a result, the contact 62 whose surface roughness Ra was 0.04 μm or less could be manufactured. However, when the surface roughness Ra is 0.04 μm or less, the plate thickness and the plate width of the contact 62 also reduce fairly, and thus the dimension should be set after a reduction at the time of the punching with the press is taken into consideration.

[Manufacturing Method 2]

After the contact 62 is punched out from the metal plate 61 as shown in FIGS. 9A to 9C, the surface of the contact 62 may be polished and the surface roughness Ra may fall within a predetermined range. As the polishing method, electrolytic polishing or buffing can be used.

[Manufacturing Method 3]

After the contact 62 is punched out from the metal plate 61 as shown in FIGS. 9A to 9C, the surface of the contact 62 may be coated with metal. For example, the surface of the contact 62 can be plated with a metal material, and can be vacuum-deposited. When the contact 62 whose surface roughness Ra is large is coated with metal, the coating metal is embedded into concave sections, and thus the surface roughness Ra becomes small.

[Manufacturing Method 4]

Figure 10A:
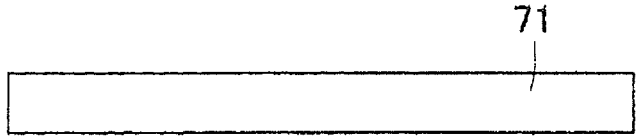
FIGS. 10A to 10G are schematic views describing a method 4 for manufacturing the contact according to one or more embodiments of the present invention.
Figure 10B:
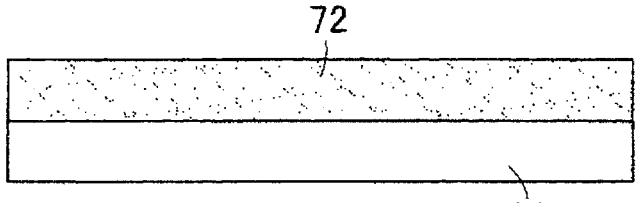
Figure 10C:
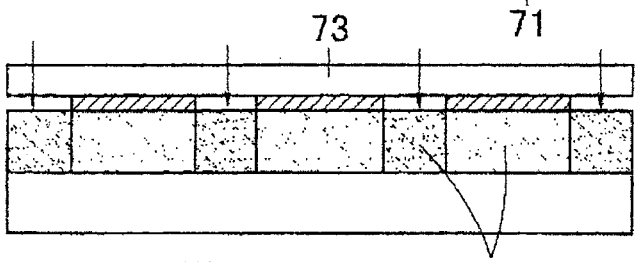
Figure 10D:
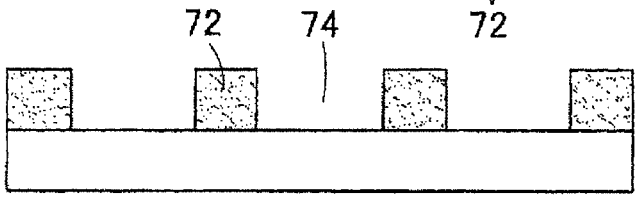
Figure 10E:
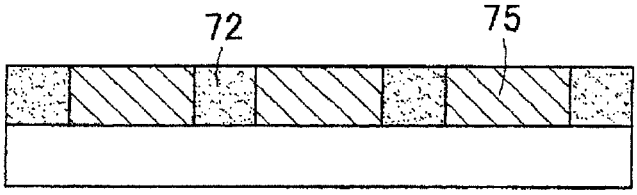
Figure 10F:
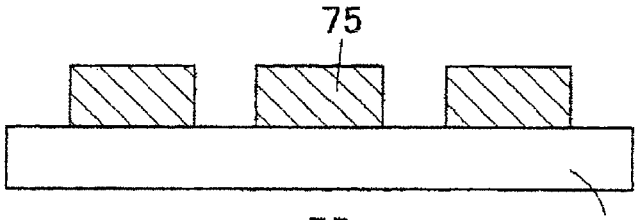
Figure 10G:
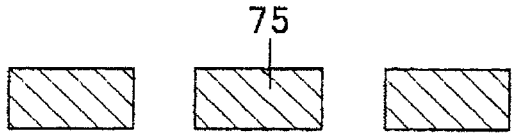

FIGS. 10A to 10G illustrate a method using photolithography and electroforming. At first, a negative resist is applied to an upper surface of an electrode plate 71 shown in FIG. 10A, and a resist film 72 is formed as shown in FIG. 10B. As shown in FIG. 10C, a photomask 73 is laminated on the resist film 72 and exposure is carried out, and then development is carried out as shown in FIG. 10D. Because an exposure region is insolubilized, the resist film 72 on a region coated with the mask and is not exposed is removed, and a cavity 74 having a contact shape is formed thereon. Thereafter, as shown in FIG. 10E, the electrode plate 71 is an electrode and the metal material is deposited in the cavity 74, so that a contact 75 is molded in the cavity 74. After the resist film 72 on the electrode plate 71 is removed as shown in FIG. 10F, the contact 75 is demolded from the electrode plate 71 as shown in FIG. 10G. With such a method, a post-process is not necessary, and contacts whose surface roughness Ra is 0.2 μm or less and 0.080 μm or less can be manufactured directly.

More specifically, this method can be further divided into some methods. First one is a method for patterning the resist film by means of a UV-LIGA process using a resist for a thick film such as Su-8 made by Kayaku Microchem. With this method, a smooth contact whose outer peripheral surface does not have unevenness can be manufactured.

The second method uses a dry film resist. As to the dry film resist, a protection film is pasted to a surface of a photosensitive layer. Because this protection film contains a lubricant, when the exposure is carried out with the protection film being pasted, stripes are formed on the wall surface of the cavity due to the lubricant and thus are transferred onto the contact. Therefore, when the dry film resist is used, the protection film is peeled and only a photosensitive layer is used as the resist film. As a result, a contact whose outer peripheral surface does not have stripes and thus is smooth can be manufactured. When the photosensitive layer of the dry film resist causes oxygen inhibition, the protection film is peeled from the photosensitive layer, and the exposure may be carried out in an environment without oxygen such as an $N_2$ atmosphere or a vacuum atmosphere.

A third method is a method using an LIGA process. This method uses polymethylmethacrylate (PMMA) as a resist, and at the time of exposure, an SR light X ray is applied instead of ultraviolet irradiation, and a pattern of an X ray absorber is transferred onto the resist film. As a result, a metal part without unevenness on the wall surface is formed.

[Manufacturing Method 5]

With this manufacturing method, in a step in FIG. 10B, the dry film resist is pasted onto the electrode plate 71 so that the resist film 72 is formed. At this time, the protection film is not peeled from the dry film resist and the protection film remains on the photosensitive layer (the resist film). Similarly to the manufacturing method 4, the contact 75 is manufactured through a photolithography or electroforming step in FIGS. 10C to 10G.

However, because roll winding is carried out on the dry film resist at the manufacturing step, particles that are called as lubricants are mixed in the protection film in order to improve a smoothing property at that time. When the dry film resist is used in order to form the resist film, a photosensitive layer of the dry film resist has an oxygen inhibition property, and thus the exposure is carried out with the protection film remaining in order to prevent touching with oxygen. At the time of the exposure, the lubricant causes light scattering and a light intensity distribution changes so that vertical lines are generated on a boundary between a hardened portion and an unhardened portion of the resist film.

Therefore, in this manufacturing method 5, in the contact 75 at a stage in FIG. 10G, the surface roughness Ra of the outer peripheral surface becomes large. Therefore, in the manufacturing method 5, in a next step in FIG. 10G, the contact 75 is etched. When, for example, an etching liquid S-CLEAN MY-28 or the like made by SASAKI CHEMICAL CO., LTD. is used as an etching liquid, the surface roughness Ra of the contact can be 0.04 μm or less. In another manner, not etching (chemical polishing) but electrolytic polishing or buffing is carried out so that the surface roughness Ra may be small.

Description of Symbols

31, 62, 75: contact
32: fixing piece
33: movable piece
34: connecting section
35: movable contact point
41: connector
42: housing
51: connector
52: connector housing
53: contact
59: battery
61: metal plate
71: electrode plate
72: resist film
73: photomask
74: cavity While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

The invention claimed is:

1. A method for manufacturing a contact comprising: a plate with a width that ranges from 0.1 mm or more to 1 mm or less; and a stress concentrated place, wherein a surface roughness (Ra) on the stress concentrated place is 0.2 μm or less, the method comprising the steps of:

forming a resist film on an electrode plate;

exposing and developing the resist film so as to form a cavity;

molding the contact in the cavity by means of electroforming; and etching or polishing a surface of the contact separated from the resist film so that surface roughness Ra is 0.2 μm or less.

2. A method for manufacturing a contact comprising: a plate with a width that ranges from 0.1 mm or more to 1 mm or less; and a stress concentrated place, wherein a surface roughness (Ra) on the stress concentrated place is 0.2 μm or less, the method comprising the steps of:

pasting a dry film resist closely onto an electrode plate;

exposing and developing the dry film resist with a protection film remaining on a surface of the dry film resist so as to form a cavity;

molding the contact in the cavity by means of electroforming; and etching or polishing a surface of the contact separated from the dry film resist so that surface roughness Ra is 0.2 μm or less.

3. A method for manufacturing a contact comprising: a plate with a width that ranges from 0.1 mm or more to 1 mm or less; and a stress concentrated place, wherein a surface roughness (Ra) on the stress concentrated place is 0.2 μm or less, the method comprising the steps of:

applying a resist liquid to an electrode plate so as to form a resist film;

forming a cavity on the resist film by means of an LIGA process; and molding the contact in the cavity by means of electroforming.

4. A method for manufacturing a contact comprising: a plate with a width that ranges from 0.1 mm or more to 1 mm or less; and a stress concentrated place, wherein a surface roughness (Ra) on the stress concentrated place is 0.2 μm or less, the method comprising the steps of:

applying a resist liquid to an electrode plate so as to form a resist film;

forming a cavity on the resist film by means of a UV-LIGA process; and molding the contact in the cavity by manes of electroforming.

5. A method for manufacturing a contact comprising: a plate with a width that ranges from 0.1 mm or more to 1 mm or less; and a stress concentrated place, wherein a surface roughness (Ra) on the stress concentrated place is 0.2 μm or less, the method comprising the steps of:

pasting a dry film resist closely onto an electrode plate and removing a protection film on a surface so that a photosensitive layer is exposed;

exposing and developing the photosensitive layer in a non-oxygen atmosphere so as to form a cavity; and molding the contact in the cavity by means of electroforming.

* * * * *